313-422 SR
3/8/88 XR 4,730,203

United States Patent [19]

Watanabe et al.

[11] Patent Number: 4,730,203

[45] Date of Patent: Mar. 8, 1988

[54] WRITE HEAD FOR AN OPTICAL PRINTER

[75] Inventors: Hiroshi Watanabe; Yukihiko Shimizu, both of Mobara, Japan

[73] Assignee: Futaba Denshi Kogyo Kabushiki Kaisha, Mobara, Japan

[21] Appl. No.: 893,618

[22] Filed: Aug. 6, 1986

[30] Foreign Application Priority Data

Aug. 10, 1985 [JP] Japan ..... 60-174997
Nov. 20, 1985 [JP] Japan ..... 60-260671

[51] Int. Cl.[4] ..... G03G 15/00

[52] U.S. Cl. ..... 355/3 R; 355/3 CH; 313/497; 313/495; 313/422

[58] Field of Search ..... 355/3 CH, 3 R, 14 R; 313/497, 495, 422

[56] References Cited

U.S. PATENT DOCUMENTS 4,675,572 6/1987 Watanabe et al. ..... 313/497 X

*Primary Examiner*—A. C. Prescott
*Attorney, Agent, or Firm*—Oblon, Fisher, Spivak, McClelland & Maier

[57] ABSTRACT

A write head for an optical printer using a vacuum fluorescent tube. The write head includes strip like anodes 12 having a phosphor layer 16, control electrodes 14 having slits 15 formed obliquely across the anodes and a first plate-like control electrode 19 having slits 20 formed at positions corresponding to the slits 15 of the second control electrodes 14.

8 Claims, 9 Drawing Figures

WRITE HEAD FOR AN OPTICAL PRINTER

BACKGROUND OF THE INVENTION

1. Field of the Invention

This present invention relates to a write head for an optical printer, and more particularly to a write head for an optical printer which comprises a vacuum fluorescent tube using the principle of a fluorescent display tube.

2. Description of the Prior Art

An optical printer, as illustrated in FIG. 1, typically includes a record medium 101 such as a photosensitive drum, a belt or the like, an electrifier 102 for uniformly electrifying a surface of the record medium 101, a write head 103 for irradiating light on the electrified record medium while carrying out an ON-OFF operation in dependence upon a write signal, a developing device 104 for adhering toner to a portion of the record medium from which charge is removed due to the irradiation during the exposure step, a transfer device 105 for carrying out the transfer on to decalcomania paper after the development step, a fixing device 106 for carrying out the fixing on the transferred decalcomania paper by heat or the like, an erasing device 107 for removing charge from the surface of the record medium 101 after the transfer step, and a cleaning device 108 for removing toner remaining on the surface of the record medium 101 and cleaning the surface.

The optical printer is classified depending upon the type of write head used in the exposure step.

One type is the laser printer which uses a laser beam emitting element as its write head and is adapted to scan the record medium while carrying out ON-OFF switching of the laser beam. Unfortunately, this has the disadvantage of being complicated and large-sized. Also, the laser printer takes a considerable length of time to reach high-speed stability since it requires a drive mechanism for a high speed rotation mirror to carry out the scanning of the laser beam. It has a further disadvantage in that its reliability deteriorates as the rotating portion of the drive mechanism etc. wears.

Another optical printer is the LED printer which uses an LED (light-emitting diode) as its write head. However, techniques for connecting a large number of LED elements to one another are highly complicated and troublesome. Also, the LEDs are elements independent from one another, so that dispersion in luminance occurs between the LEDs. Accordingly, it requires a difficult and complicated LED selecting operation to obtain uniform luminance.

In order to eliminate the problems described above, a vacuum fluorescent tube using the principle of a fluorescent display tube was proposed as a write head for an optical printer.

For example, Japanese Patent Application Laid-Open Publication No. 46740/1984 discloses a vacuum fluorescent tube for an optical printer which uses a static driving system of 1 in duty and a dynamic driving system of ½ in duty. However, a vacuum fluorescent tube for an optical printer requires a large number of emission dots, for example, as many as above 3000 per line of A4 size paper, resulting in the need for very large numbers of anode leads and driving integrated circuits which in turn result in a substantial increase in manufacturing costs.

In view of the foregoing, the present inventors proposed the use of, a vacuum fluorescent tube as a write head for an optical printer, such as the dynamic driving system shown in FIG. 2.

This proposed write head includes a substrate 1, a plurality of strip-like anode conductors 2 arranged in parallel at intervals on the substrate 1, and a plurality of strip-like grids 3 arranged in parallel at intervals above the anode conductors 2 so as to extend obliquely across the anode conductors. The grids 3 each are formed like a flat plate and each have a slit 4 at their central portion which extends in the oblique direction across the anode conductors 2. The anode conductors 2 each have a phosphor layer 5 deposited at intervals opposite the slits 4 of the grids 3 and adjacent thereto, so that an anode 6 may be formed. Each of the phosphor layers 5 obliquely arranged along the slits 4 constitutes a group of picture cells.

The write head also includes filaments stretched above the grids 3. Reference numerals 8 and 9 designate a front cover and side plates, respectively, which form a sealed casing together with the substrate. The casing is kept in an evacuated state.

Electrodes, such as grid terminals, lead out from the sealed casing and the like and are connected to a driver circuit (not shown), so that the anodes 6 each may be scanned by means of a time-division pulse signal and a positive display pulse may be applied to the grids 3 desired in synchronism with the scanning, resulting in any dot-like fluorescent phosphor layers 5 selectively carrying out emission. However, electrons emitted from the filaments 7 often impinge those phosphor layers 5 from which emission is not desired, so causing leakage emission. In order to prevent such a defect, the vacuum fluorescent tube is constructed to apply a negative voltage of the grids 3 for the phosphor layers 5 which are not desired to carry out emission.

The vacuum fluorescent tube constructed described above is arranged in the optical printer so that the axis of the photosensitive drum acting as the record medium is parallel to the direction of arrangement of the anode conductors 2. This causes the arrays of the dot-like phosphor layers 5 belonging to each group to be oblique with respect to the axis of the photosensitive drum. However, a suitable electrical signal treatment required to adjust suitably the timing of emission of each phosphor layer 5 depending upon the rotational speed of the photosensitive drum results in light irradiated from each of the phosphor layers 5 forming a straight line on a surface of the photosensitive drum parallel to its axis. Thus, the vacuum fluorescent tube allows for an interval between adjacent phosphor layers which is larger than the dot pitch in printing, resulting in many advantages in manufacture, because light emitted from each of the obliquely arranged phosphor layers 5 of each group is irradiated to a position in a line on the surface of the photosensitive drum.

As described above, in the vacuum fluorescent tube for a write head for an optical printer, a negative voltage (cut-off bias) is applied to the grids 3 corresponding to the phosphor layers 5 which are not desired to carry out emission, for the purpose of preventing leakage emission. However, this is disadvantageous in that electrons are subjected to repulsion due to the negative voltage generated by the cut-off bias, so that the direction of travel of the electrons may be deflected. This causes the electrons to fail to impinge on the phosphor layers which are intended to carry out emission, resulting in eclipse or shading which is the phenomenon occurring when a part of a phosphor layer fails in emission.

FIG. 3 shows diagrammatically the positions of the electrodes in a conventional vacuum fluorescent tube in which a cut-off bias is applied to a part of the grids 3*a* and equipotential lines produced by a voltage applied thereto. Electrons emitted from the filaments describe loci perpendicular to the equipotential lines. Accordingly, in the vicinity of the grids 3*c*, the electrons are downwardly accelerated due to a positive potential of the grids 3*c*, as diagrammatically shown in FIG. 4, resulting in impingement on the phosphor layers 5; whereas, in the vicinity of the grids 3*b*, the direction of travel of the electrons is substantially deflected due to a negative voltage of the adjacent grids 3*a*, so that the electrons are caused to impinge on only a part of the phosphor layers 5 which are desired to carry out emission, resulting in eclipse.

Also, the application of a cut-off bias to both grids 3 adjacent to the grids 3 to which a positive voltage is applied causes a decrease in luminance due to a decrease in the number of electrons impinging on the phosphor layers, although this often prevents the occurrence of eclipse.

Furthermore, the conventional vacuum fluorescent tube has another disadvantage in that it is necessary to align vertically the position of the slit 4 of each grid 3 precisely with that of the corresponding phosphor layer 5 deposited in a dot-like manner on the anode conductor 2, resulting in difficulties in manufacture.

SUMMARY OF THE INVENTION

The present invention has been made in view of the foregoing disadvantages of the prior art.

Accordingly, it is an object of the present invention to provide a write head for an optical printer utilizing a vacuum fluorescent tube of the dynamic driving and anode scanning type which is capable of eliminating problems such as eclipse due to a negative voltage of adjacent grids and the like, and which enables the alignment of components without high precision to facilitate the manufacture.

It is another object of the present invention to provide a write head for an optical printer which is capable of decreasing the reactive current flowing through control electrodes to minimise scattering of luminance, decrease in luminance and deformation of the substrate and the like due to exoergic behavior of the control electrodes.

In accordance with the present invention, there is provided a write head for an optical printer in the form of a vacuum flourescent tube comprising a substrate; a plurality of strip-like anode conductors arranged in parallel on the substrate; phosphor layers deposited on the anode conductors; control electrodes arranged above the anode conductors; and cathodes stretched above the control electrodes; the control electrodes comprising a plurality of second control electrodes formed with slits which cross the anode conductors obliquely, and a first control electrode arranged above the second control electrode, the first control electrode being formed with slits at positions corresponding to the slits of the second control electrodes.

As can be seen from the foregoing, in the present invention, the single first control electrode to which a positive voltage can be applied is provided in addition to a plurality of the second control electrodes to which a display signal or cut-off bias can be applied, in order to decrease the influence of a negative field on adjacent second control electrodes.

Preferably, the slits of the first control electrode are greater in width than the slits of the second control electrodes. The phosphor layer is adapted to carry out emission in the form of dots and is preferably uniformly and continuously deposited on the anode conductors.

Preferably, the first control electrode has a control section corresponding to the region in which the slits are located and an insulating layer arranged on the surface of the first control electrode other than over the control section. Preferably, the insulating layer is a flat glass plate.

Accordingly, the present invention may provide a write head for an optical printer of the dynamic driving and anode scanning type which does not substantially suffer from eclipse.

Also, the write head of the present invention is contructed so that the first control electrode covers the unnecessary portion of each of the phosphor layers; accordingly, the second control electrodes can be aligned without requiring high precision, so that a lot of advantages may be experienced in manufacture. Furthermore, in the present invention, the first control electrode is covered with the insulating layer except for the slits near the filamentary cathodes and the portion adjacent thereto, resulting in the grid current flowing through the first control electrode being decreased to a level as small as 50 mA or less, as compared with about 150 mA in the prior art. Accordingly, the present invention may decrease the reactive current which does not contribute to emission from the phosphor layer, so that energy can be saved while a luminance equal to that in the prior art may be exhibited.

In addition, a decrease in the reactive current decreases the grid current to a degree sufficient to prevent exoergic behaviour of the control electrodes, so that thermal deformation of the substrate and a decrease in luminance due to a variation in the temperature of the phosphor layer may be effectively prevented.

Moreover, the present invention may result in a decrease in the capacity of the power supply for the filamentary cathodes in order to decrease cost still further.

BRIEF DESCRIPTION OF THE DRAWINGS

The invention may be carried into practice in various ways and some embodiments will now be described with reference to the accompanying drawings in which.

DETAILED DESCRIPTION OF THE PREFERRED EMBODIMENTS

Figure 1:
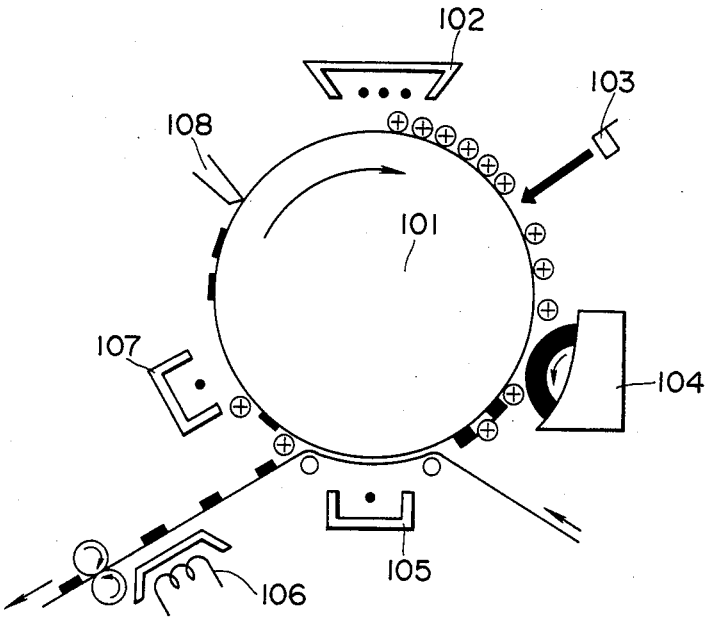
FIG. 1 PRIOR ART
FIGS. 1 through 4 illustrate the prior art.
Figure 2:
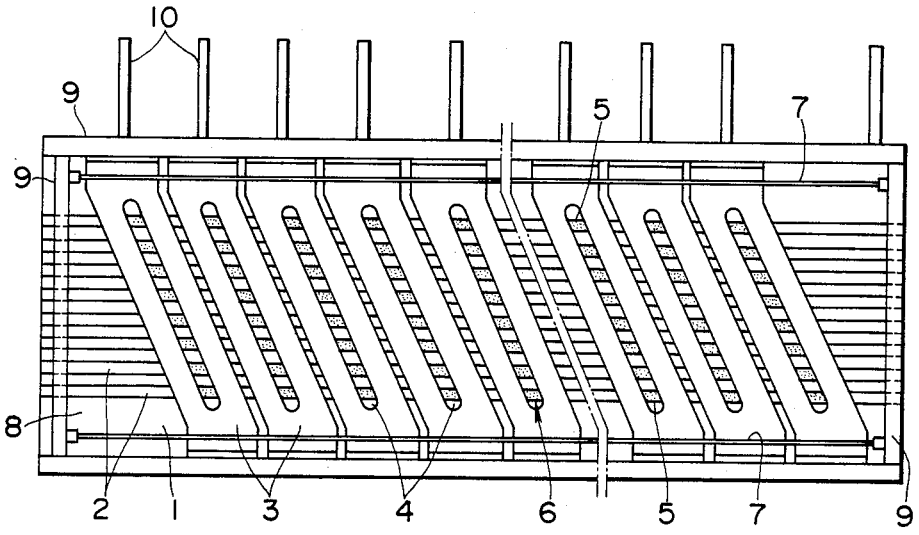
FIG. 2 PRIOR ART
Figure 3:
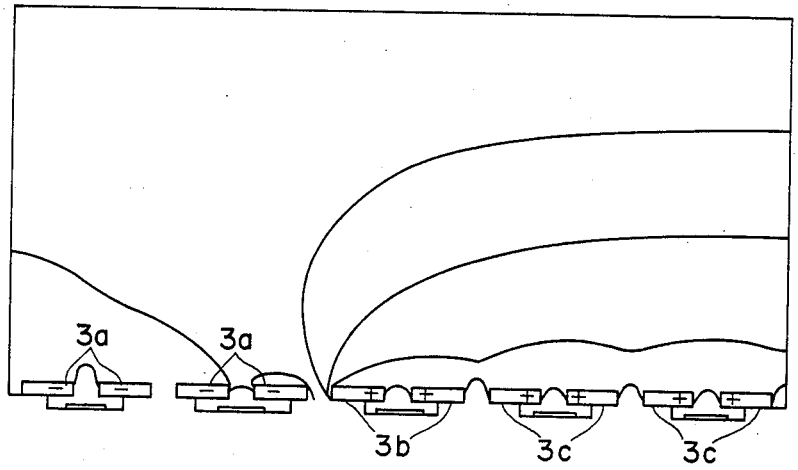
FIG. 3 PRIOR ART
Figure 4:
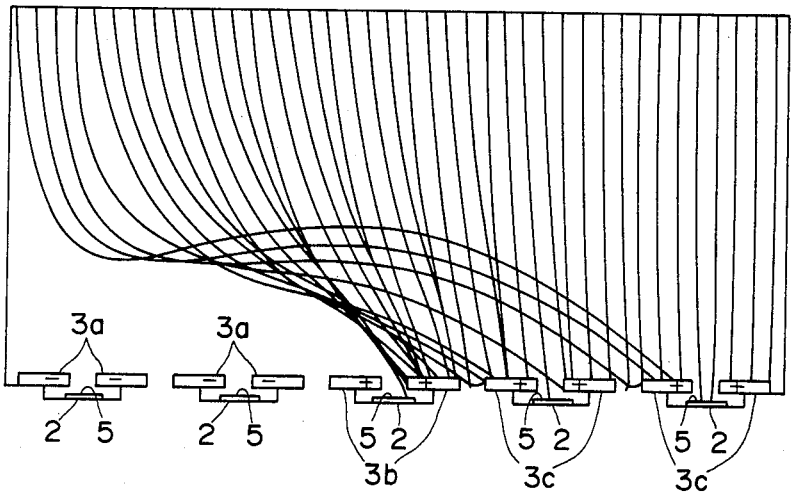
FIG. 4 PRIOR ART
Figure 5:
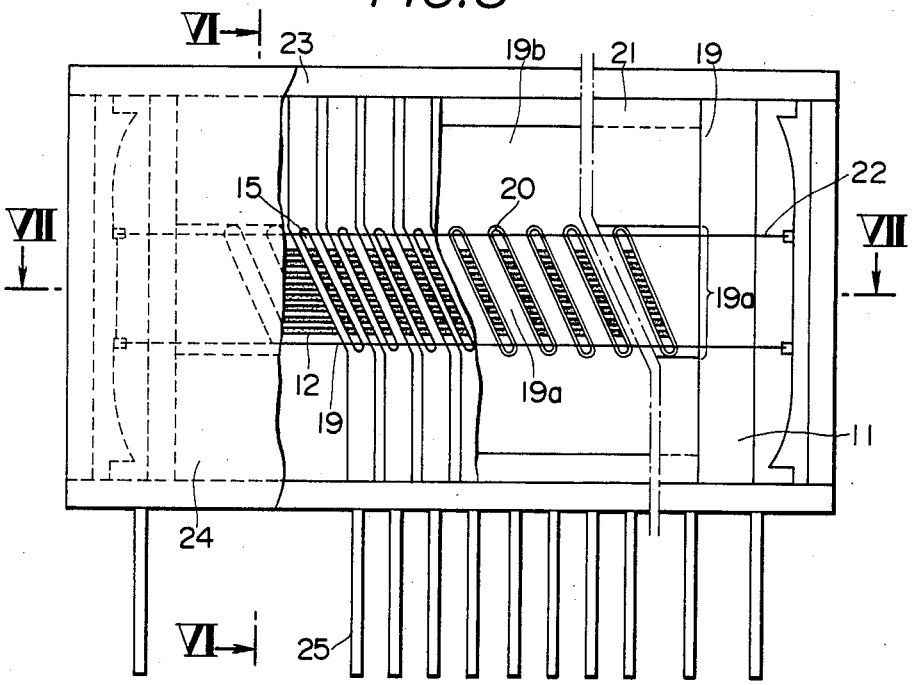
FIG. 5 is a partially cutaway plan view showing an embodiment of a write head for an optical printer according to the present invention, from which a central portion of the write head is deleted.

The write head of the illustrated embodiment includes a substrate 11 formed of an insulating material such as glass or the like. The dimensions of the substrate depend upon the size of the optical printer in which the write head is to be incorporated. For example, it may have dimensions of about 20 mm×300 mm when printing is to be carried out on A4 size paper.

The write head also includes a plurality of strip-like anode conductors 12 arranged in parallel to one another on the substrate 11. In the illustrated embodiment, eight such anode conductors are provided. The anode conductors 12 may be made by treating an aluminium film deposited on the overall surface of the substrate 11 by photolithography to form the film into a plurality of strips. The anode conductors 12 each have a width of 0.1 mm or less and the interval between adjacent anode conductors is defined to be 0.1 mm or less. Accordingly, the arrangement of eight anode conductors results in the width of the arrangement of the anode conductors to be as small as 1–2 mm. The anode conductor group 1–2 mm in width is positioned in the middle of the substrate 11.

The write head of the illustrated embodiment further includes a plurality of second control electrodes 14 arranged above the anode conductors 12 through an insulating layer 13 of a uniform thickness formed on each of both edges of the substrate 11. The second control electrodes 14 are flat in shape and arranged obliquely across the anode conductors 12. The electrodes 14 extend parallel to one another and are electrically independent from one another. The second control electrodes 14 each have a slit 15 formed at their central portions so that the slits also extend obliquely across the anode conductors.

The anode conductors 12 each have a phosphor layer 16 continuously and thoroughly coated thereon, thus forming anodes 17. However, it should be noted that not all the phosphor 16 that is present contributes to emission as described hereinafter. More particularly, a portion of the phosphor layer 16 which carries out emission due to impingement of electrons thereon is substantially limited to that viewed through the slits 15, Thus, in the illustrated embodiment, it is not required to align precisely the slits 15 with the phosphor layers 16 deposited in the form of dots, resulting in simplified manufacturing processes. It might be thought that the portion of the phosphor layer 16 appearing between each two adjacent second control electrodes 14 would carry out emission. However, this does not raise any difficulties since these portions are hidden by a first control electrode 19, as described hereinafter.

A light emitting portion of each of the phosphor layers 16 obliquely positioned along each of the slits 15 constitutes a picture cell in each picture cell array.

The second control electrodes 14 have at each end a spacer 18 to which an adhesive composed of a sealing cement of crystalline glass and the like is applied. The first control electrode 19 is located above the second control electrodes 14 by means of the spacers 18. The first control electrode 19 is formed of a single plate-like material and is provided with slits 20 of a size larger than the slits 15 of the second control electrodes 14 at positions corresponding to the slits 15. Thus, each portion of each of the phosphor layers 16 viewed through both slits 15 and 20 constitutes an effective light emitting portion.

The edges of the first control electrode 19 at the two ends of the slits 20 are in the form of a metal plate and each constitutes a support section **19*b* holding between them a control section 19*a*. An insulating layer 21 comprising a flat glass plate is bonded to the support section by means of a sealing cement or the like. The insulating layer 21 serves to fix the first control electrode 19 on the insulating layer 18. It also covers the holding portion 19*b* which does not need to be an electrically conductive part of the first control electrode 19, and so prevents electrons emitted from cathodes 22 from reaching it thereby substantially decreasing the reactive current. As a result, effective electrons which contribute to the emission of the phosphor layer are distributed around the slits 20 and the control section 19*a* adjacent thereto, and electrons directed to the holding portion 19*b* form an invalid grid current which does not contribute to the emission. An increase in the grid current leads to exoergic behaviour by the control electrode resulting in thermal deformation and so a variation of the distance between the control electrode and the anodes 17**. This causes problems such as non-uniform luminance (due to a variation of the luminance), a decrease in luminous efficiency due to the increase in temperature in an envelope, and deflection of the substrate due to differences in the coefficients of thermal expansion.

In view of the above, the insulating layer 21 ensures that only the control section **19*b* of the electrode 19 exhibits electrical action with conductivity and insulates the surface of the remainder of electrode, present for mechanical reasons. Such a construction causes electrons emitted from the cathode to be attracted to only the control section 19*b* of the control electrode 19**. This results in the area of the control electrode which has conductivity being about one third that in a conventional write head, thereby decreasing the grid current correspondingly. This does not decrease luminance, which is kept at a level equivalent to that in a conventional write head, and the reactive current, which does not contribute to emission of the phosphor layer, is decreased. A decrease in a reactive current decreases the exogergic behaviour of the control electrode to a degree sufficient to prevent a temperature rise in the write head.

The write head of the illustrated embodiment also includes filamentary cathodes 22 stretched above the first control electrode 19. A housing which comprises side plates 23 and a front cover 24, is sealedly fixed on the substrate 11 by means of a sealant, which forms a casing together with the substrate. The casing is kept at a high vacuum atmosphere.

Electrodes such as grid terminals lead out from the sealed casing and are connected to a driver circuit (not shown), so that the anodes 17 may be scanned by means of a time-division pulse signal and a positive display pulse signal may be applied to the second control electrodes desired in synchronism with the scanning, resulting in the light emitting portions of the phosphor layers selectively carrying out emission.

The second control electrodes 14 corresponding to the phosphor layers 16 which are not desired to carry out emission have a cut-off bias applied to them for the purpose of preventing leakage emission as in the conventional write head.

In the illustrated embodiment, the first control electrode 19 is arranged to have a positive voltage applied to it to prevent eclipse. In the proposed embodiment, the voltages applied to the anodes, the second control electrodes and the first control electrode may be set to be 300–350 V, 80–100 V and 40–50 V, respectively.

The manner of operation of the write head constructed above will now be described.

Figure 8:
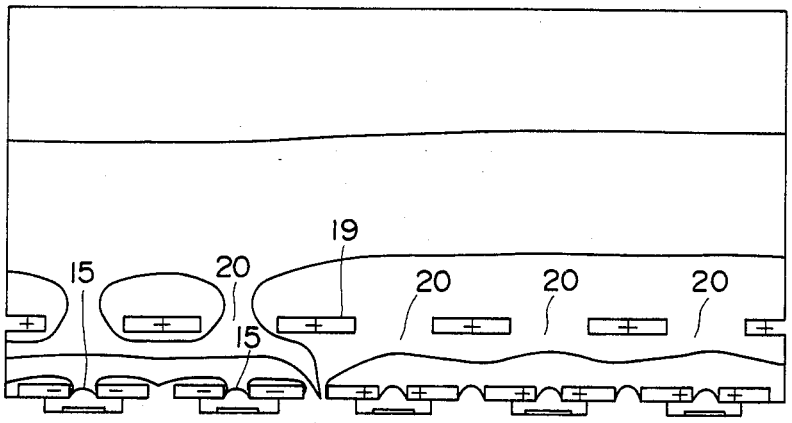
FIG. 8 is a diagrammatic view showing the distribution of an electric field produced when a write head for an optical printer according to the present invention is driven.
Figure 9:
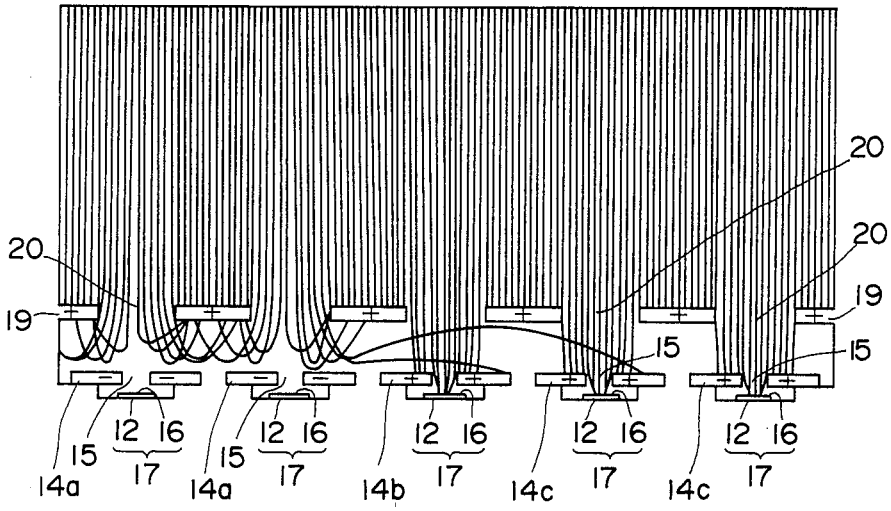
FIG. 9 is a diagrammatic view showing the loci of electrons produced when a write head of the present invention is driven.

FIG. 8 diagrammatically shows the positions of the respective electrodes arranged in the vacuum fluorescent tube of the illustrated embodiment and equipotential lines in the electric field generated by voltages applied to the electrodes when the vacuum fluorescent tube is driven, and FIG. 9 diagrammatically shows loci of electrons in the tube.

First a current is supplied to the filamentary cathodes 22 to heat them and a positive voltage of a predetermined level is applied to the first control electrode 19. Then, the driver circuit is driven to scan each of the anodes 17 by means of a time-division pulse signal and a positive display pulse signal is supplied to the second control electrodes 14 desired, in synchronism with the scanning.

The following description is made on the assumption that a negative voltage is applied to the second control electrodes 14*a* at a certain moment and a positive display signal is fed to the second control electrodes 14*b* and 14*c*, as shown in FIGS. 8 and 9.

An electric field between the filamentary cathodes 22 and the first control electrode 9 is substantially uniformly formed as shown in FIG. 8.

Figure 6:
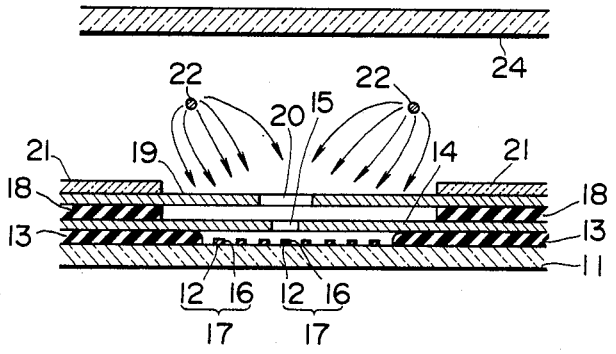
FIG. 6 is a sectional view taken along line VI—VI of FIG. 5.
Figure 7:
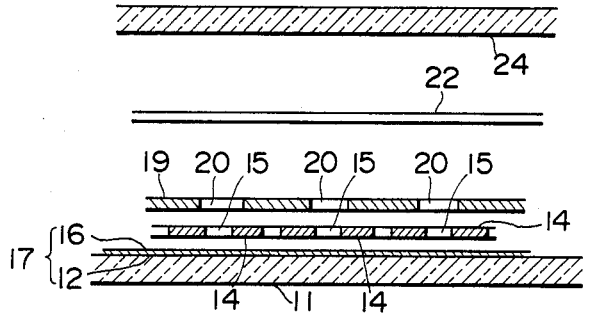
FIG. 7 is a sectional view taken along line VII—VII of FIG. 5.

Electrons emitted from the cathodes 22 are attracted to the first control electrode 19 because it has a positive voltage constantly applied to it. However, the first control electrode 19 is substantially covered with the insulating layer 21 except for the slits 20 and the control section 19*a* in their vicinity, so that the electrons may be concentrated towards the slits 20 and the control section 19*a*, as shown in FIG. 6. The electrons accelerated by the electric field pass through the slits 20 while describing loci substantially perpendicular to the slits and travel toward the second control electrodes 14. The second control electrodes 14 opposite to the dots or phosphor layers which are to carry out emission have a positive voltage applied to them. The electrons passing through the slits 15 of the second control electrodes 14 then impinge upon the phosphor layers 16 to cause the emission from the phosphor layers.

When emission is not desired, a negative voltage is applied to the second control electrodes 14. This causes the electrons to be deflected back to the first control electrode 19. Accordingly, these electrons are prevented from passing through the slits 15 of the second control electrodes 14 to impinge on the phosphor layers 16.

Thus, the illustrated embodiment is constructed to allow only the portion of the first control electrode which contributes to the control of emission to function as a control electrode and removes an electrical function from that portion of the first control electrode which serves to support the electrode and provide it with mechanical strength, resulting in a substantial decrease in the current flowing through the first control electrode.

Electrons directed to the second control electrodes 14*b* are affected to a maximum degree by the second control electrodes 14*a* having a negative voltage applied to them, however, the direction of travel of the electrons does not significantly change because a considerable velocity is imparted to them as they pass through the slits 20 of the first control electrode 19. The effect of the electrodes 14*a* on the electrons is seen at only a narrow region between the first and second control electrodes 19 and 14. Thus, the electrons which are intended are allowed to impinge on the required phosphor layers 16 without deflection and consequently the layers 16 may carry out emission without any substantial eclipse occurring.

In the illustrated embodiment, the strip-like anode conductors each have the corresponding phosphor layer 16 thoroughly deposited on them, so that the alignment of the second control electrodes in the assembly of the device may be facilitated. Also, the portion of the phosphor layer 16 appearing between adjacent second control electrodes is hidden by the first control electrode 19.

The deposition of the phosphor layers may alternatively be carried out in such a manner that they are deposited at given intervals on the anode conductors 12 to form dots as in the prior art. In this instance, the phosphor layers 16 can each be formed to have an area larger those in the prior art, which permits the operation of aligning each of the slits 15 of the second control electrodes 14 with the corresponding phosphor layer 16 much ease. Even when the phosphor layer 16 is forced out between the adjacent second control electrodes, it is hidden by the first control electrode 19 as in the embodiment described above.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A write head for an optical printer in the form of a vacuum fluorescent tube comprising: a substrate; a plurality of strip-like anode conductors arranged in parallel on the substrate; phosphor layers deposited on the anode conductors; control electrodes arranged above the anode conductors; and cathodes stretched above the control electrodes; the control electrodes comprising a plurality of second control electrodes formed with slits which cross the anode conductors obliquely, and a first control electrode arranged above the second control electrode, at positions the first control electrode being formed with slits at positions corresponding to the slits of the second control electrodes.

2. A write head as claimed in claim 1 in which the slits of the first control electrode are greater in width than the slits of the second control electrodes.

3. A write head as claimed in claim 1 or claim 2 in which the phosphor is uniformly and continuously deposited on the anode conductors.

4. A write head as claimed in claims 1 or 2 in which the first control electrode has a control section corresponding to the region in which the slits are located and an insulating layer arranged on the surface of the first control electrode other then over the control section.

5. A write head as claimed in claims 1 or 2 in which the insulating layer is a flat glass plate.

6. A write head as claimed in claim 3 in which the first control electrode has a control section corresponding to the region in which the slits are located and an insulating layer arranged on the surface of the first control electrode other than over the control section.

7. A write head as claimed in claim 3 in which the insulating layer is a flat glass plate.

8. A write head as claimed in claim 4 in which the insulating layer is a flat glass plate.

* * * * *